US005170155A

United States Patent [19]

Plus et al.

[11] Patent Number: 5,170,155

[45] Date of Patent: Dec. 8, 1992

[54] SYSTEM FOR APPLYING BRIGHTNESS SIGNALS TO A DISPLAY DEVICE AND COMPARATOR THEREFORE

[75] Inventors: Dora Plus, South Bound Brook; Leopold A. Harwood, Bridgewater, both of N.J.

[73] Assignee: Thomson S.A., Courbevoie, France

[21] Appl. No.: 600,046

[22] Filed: Oct. 19, 1990

[51] Int. Cl.[5] ..... G09G 3/36

[52] U.S. Cl. ..... 340/784; 340/793; 340/805

[58] Field of Search ..... 340/784, 802, 811, 805, 340/719; 437/40, 43; 350/332, 333

[56] References Cited

U.S. PATENT DOCUMENTS

| | | | |
|---|---|---|---|
| 3,676,702 | 7/1972 | McGrogan, Jr. | 307/235 |
| 4,070,600 | 1/1978 | Butler et al. | 340/811 |
| 4,532,438 | 7/1985 | Reiner | 307/362 |
| 4,742,346 | 5/1988 | Gillette et al. | 340/805 |
| 4,766,430 | 8/1988 | Gillette et al. | 340/793 |
| 4,841,294 | 6/1989 | Clerc | 340/793 |
| 4,963,860 | 10/1990 | Stewart | 340/811 |
| 5,017,914 | 5/1991 | Uchida et al. | 340/784 |

FOREIGN PATENT DOCUMENTS

| | | |
|---|---|---|
| 0298255 | 1/1989 | European Pat. Off. . |
| 0381429 | 8/1990 | European Pat. Off. . |
| 0417578 | 3/1991 | European Pat. Off. . |

OTHER PUBLICATIONS

Supertex Inc., Databook 1988-1989, HV08, pp. 11-35 to 11-38 & attachment A, 1988.

*Primary Examiner*—Alvin E. Oberley
*Assistant Examiner*—S. Saras
*Attorney, Agent, or Firm*—J. S. Tripoli; D. H. Irlbeck; L. L. Hallacher

[57] ABSTRACT

A system for applying brightness signals to the pixels of a display device includes a transmission gate for each column of pixels. The control electrodes of the transmission gates are precharged to the threshold voltage of the gates to substantially increase the speed of the system. Comparators compare brightness voltages to a reference ramp voltage to enhance the speed and accuracy of the system.

12 Claims, 4 Drawing Sheets

SYSTEM FOR APPLYING BRIGHTNESS SIGNALS TO A DISPLAY DEVICE AND COMPARATOR THEREFORE

BACKGROUND

This invention relates generally to drive circuits for display devices and particularly to a system for applying brightness signals to the pixels of a display device, such as a liquid crystal display.

Many display devices, such as liquid crystal displays, are composed of a matrix of pixels arranged horizontally in rows and vertically in columns. The data to be displayed are applied as brightness (gray scale) signals to data lines which are individually associated with each column of pixels. The row of pixels are sequentially scanned and the pixels within the activated row are charged to the various brightness levels in accordance with the levels of the brightness signals applied to the individual columns. In a color display each pixel is composed of at least three pixel elements which individually emit one of the primary colors of light red, green or blue. In an active matrix display each pixel element is associated with a switching device which is used to turn the individual pixel elements on and off. Typically, the switching device is a solid state device, such as a thin film transistor (TFT), which receives the brightness information from solid state circuitry. Because both the switching devices and the circuitry are composed of solid state devices it is preferable to simultaneously fabricate the switching devices and the circuitry utilizing either amorphous silicon or polysilicon technology. Liquid crystal displays are composed of a liquid crystal material which is sandwiched between two substrates. At least one, and typically both of the substrates, is transparent to light and the surfaces of the substrates which are adjacent to the liquid crystal material support patterns of transparent conductive electrodes arranged in a pattern to form the individual pixel elements. The goal of the industry is to fabricate the various control circuitry components on the substrates and around the perimeter of the display at the same time that the solid state switching elements are fabricated.

Amorphous silicon has been the preferable technology for fabricating liquid crystal displays because this material can be fabricated at low temperatures. Low fabrication temperature is important because it permits the use of standard, readily available and inexpensive substrate materials. However, heretofore it has been felt that amorphous silicon technology can not be used because it has low mobility and thus can not operate at the speeds necessary for producing television displays. For these reasons it has heretofore been felt that fabricating the control circuitry on the same substrates as the display matrix would require the use of polysilicon because of its much higher carrier mobility. However, the disadvantage of polysilicon is the need for fabrication at high temperatures which requires the use of special and expensive substrate materials.

For these reasons there is a need for a liquid crystal drive circuit for applying the brightness signals to the pixel elements of a display device which can be fabricated utilizing either amorphous silicon or polysilicon technology. The present invention fulfills this need.

SUMMARY

A system for applying brightness signals to the individual columns of pixels in a display device having a matrix of pixels arranged in columns and rows includes a plurality of signal transmission gates arranged to individually apply the brightness signals to the columns of pixels. Each of the transmission gates has a control electrode for turning the transmission gates on and off in response a control signal exceeding a threshold level. The system includes means for precharging the control electrodes to the threshold level. The brightness signals are applied to the columns of pixels through the transmission gates.

CROSS-REFERENCE TO RELATED APPLICATIONS

This invention can be used with the invention described in application Ser. No. 600,050 filed on even date herewith by Leopold A. Harwood and Dora Plus and entitled "Liquid Crystal Display Drive Circuit And Signal Decoder Therefor".

DETAILED DESCRIPTION

Figure 1:
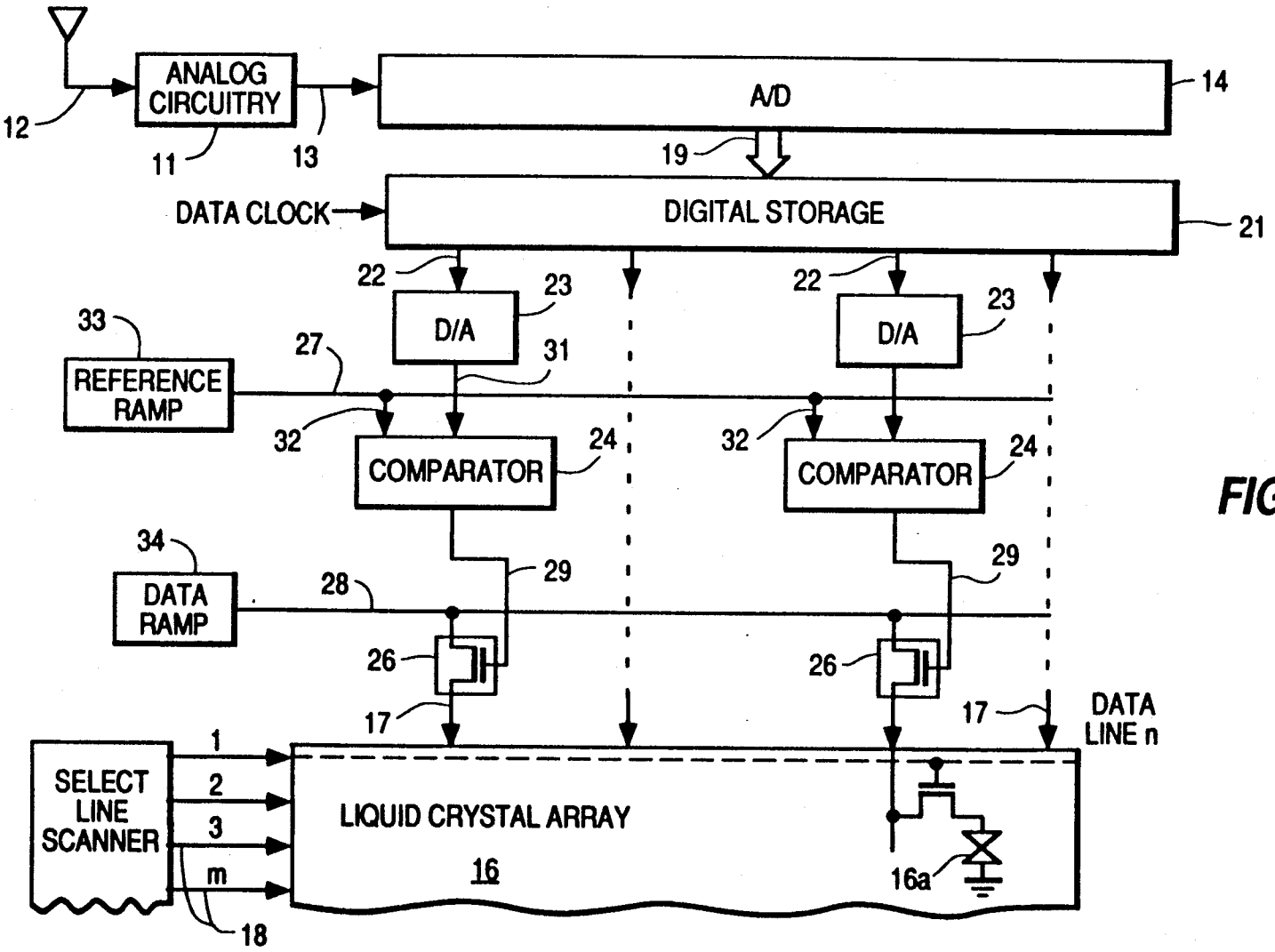
FIG. 1 is a preferred embodiment.

In FIG. 1, analog circuitry 11 receives an analog information signal representative of the data to be displayed from an antenna 12. When the incoming signal is a television video signal the analog circuitry 11 is similar to that of a standard television receiver of known type. However, the tube is replaced by a liquid crystal display device as described herein. The analog circuitry 11 provides an analog data bearing signal on a line 13 as an input signal to an analog-to-digital converter (A/D) 14. When the incoming signal is to be used for a computer graphic display the incoming signal probably will be digital and the A/D 14 is not needed.

The television signal from the analog circuitry 11 is to be displayed on a liquid crystal array 16 which is composed of a large number of pixel elements, such as the liquid crystal cell **16*a*, arranged horizontally in m rows and vertically in n columns. The liquid crystal array 16 includes n columns of data lines 17, one for each of the vertical columns of liquid crystal cells, and m select lines 18, one for each of the horizontal rows of liquid crystal cells. The A/D converter 14 includes an output bus bar 19 to provide brightness levels, or gray scale codes, to a digital storage means 21 having a plurality of output lines 22. The output lines 22 of the digital storage means 21 control the voltages applied to the data lines 17 for the columns of liquid crystal cells 16*a* through digital-to-analog converters (D/A) 23, comparators 24 and transmission gates 26. Each of the output lines 22 therefore controls the voltage applied to the liquid crystal cell in a particular column when an associated transmission gate 26 is on and in accordance with the scanning of the select lines 18. A display device using counters and a preferred embodiment of the digital storage means 21, in the form of a shift register, are described in U.S. Pat. Nos. 4,766,430 and 4,742,346 the teachings of which are incorporated herein by reference. A reference ramp generator 33 provides a reference ramp voltage signal on an output line 27. Line 27 is coupled to the comparators 24 in each of the columns of liquid crystal cells via a line 32. A data ramp generator 34 provides a data ramp to the columns of pixel elements by the connection of an output line 28 to each of the transmission gates 26. In the preferred embodiment shown, the transmission gates 26 are thin film transistors the control electrodes of which are coupled to the outputs of the comparators 24 by lines 29**.

In operation, the digitized brightness signals from the digital storage means 21 are applied by the output lines 22 to digital-to-analog converters 23, the outputs lines 31 of which are connected to one input of a comparator 24 by an output line 31. The reference ramp generator 33 supplies a reference ramp to the other input of each of the comparators 24 via lines 32. The reference ramp can be nonlinear to compensate for any nonlinearity generated in any part of the TV transmission, receiving system, or of the comparators 24. When the reference ramp voltage is lower than the brightness signal applied from the D/As 23 the output lines 29 of the comparators 24 are high and the transmission gates 26 are turned on. The voltages on the output lines 29 turn the transmission gates 26 on and off and thus serve as the control signals for the transmission gates. The data ramp on the line 28 from the data ramp generator 34 is thus applied to every pixel element which is within the actuated row, and which is associated with a turned on transmission gate 26. When the level of the reference ramp voltage reaches the level of the brightness signal from the D/A 23 the output line 29 of the comparator 24 goes low turning the associated transmission gate 26 off. The pixel element associated with the turned off transmission gate is thus charged to the level established by the analog brightness signal from the D/A 23.

Figure 2:
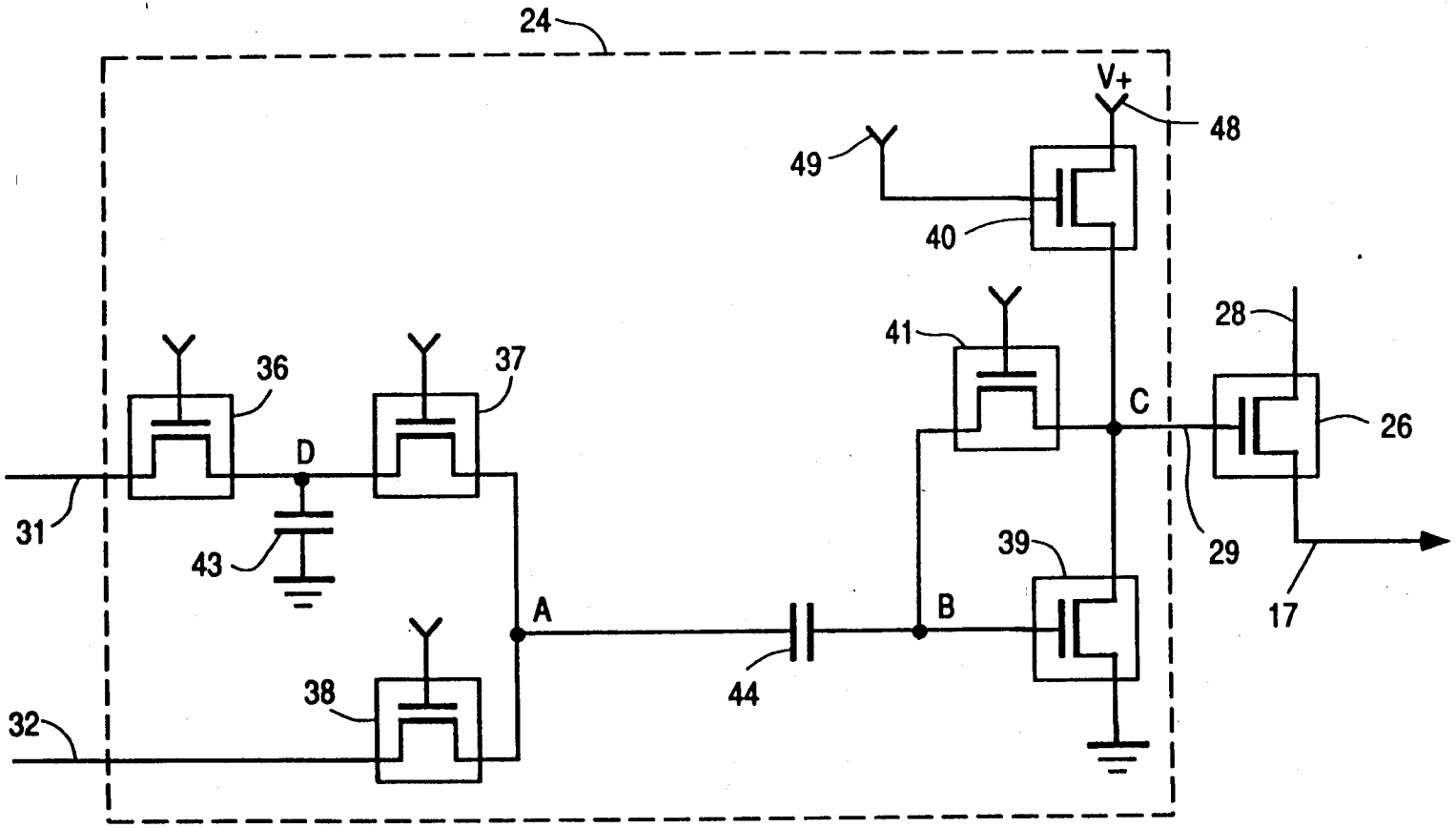
FIG. 2 is a preferred embodiment of a comparator circuit for use in the preferred embodiment of FIG. 1.

FIG. 2 is a preferred embodiment of an analog comparator 24. The analog comparator 24 includes a number of transfer gates 36 to 41, which in the preferred embodiment shown are thin film transistors (TFT). The output line 31 of the D/A 23 provides the brightness signal as an input to the transfer gate 36, which therefore is the data input device of the comparator 24. The input transfer gate 36 is coupled to a transfer gate 37, which functions as a data input switch for the comparator 24. A storage capacitor 43 is coupled to a node D between the input transfer gate 36 and the switching transfer gate, 37 and to ground. The data input to the transfer gate 36 charges the capacitor 43 to the data level, when the control electrode of the transfer gate 37 is made high the gate is turned on and transfers the signal from node D to a node A. The switching transfer gates 37 for all columns of the display are simultaneously turned on.

The lines 32, which in FIG. 1 are shown to connect the output line 27 of the reference ramp generator 33 to the comparators 24, is connected to a reference ramp transfer gate 38, which is also connected to the node A. The reference ramp transfer gate 38 controls the reference ramp timing and the timing of the precharging of node A. A coupling capacitor 44 couples node A to a node B. Node B is connected to the control electrode of a sensor transfer gate 39, which is connected between node C and ground. The transfer gate 39 serves as a sensor of the voltage on node B to control the comparator output voltage on node C. However, because node B is coupled to node A via the coupling capacitor 44, transfer gate 39 in effect senses the voltage on node A.

An auto-zero transfer gate 41 is arranged across nodes B and C. When the transfer gate 41 is turned on the control electrode and the drain of the transfer gate 39 are connected and the voltages on nodes B and C become the same. A switchable load 40 is connected between a supply voltage V+ and the output node C. The switchable load 40 can also be a TFT. The control electrode of the switchable load 40 is connected to a load control input terminal 49.

Figure 4:
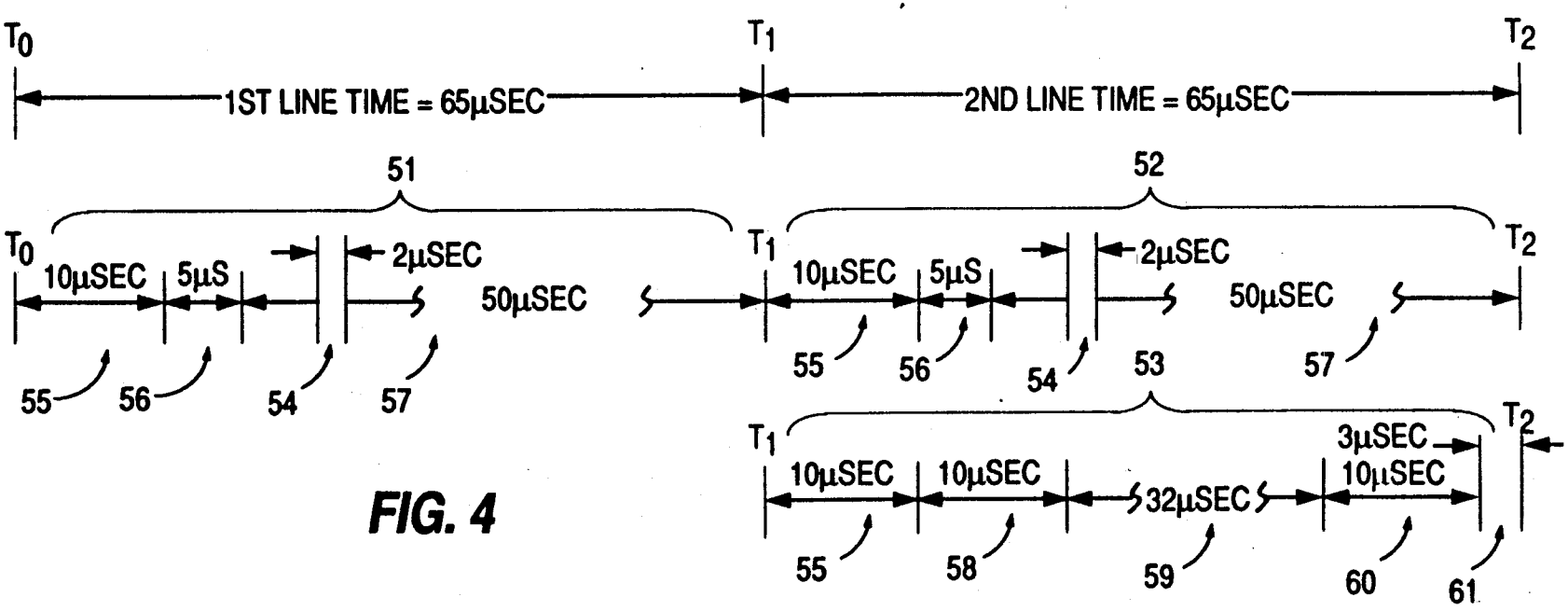
FIG. 4 shows the timing of the comparator circuit of FIG. 2.

The operation and timing of the comparator 24 are explained with reference to FIGS. 2 and 4. The operation is explained as if the display device has been off for an extended time and has just been turned on. In FIG. 4 a first line time 51 begins at time $T_0$ and lasts for 65 microseconds. During an initial period 55, which is 10 microseconds long, the input transfer gate 36 is turned off and the switching transfer gate 37 is turned on to transfer data from node D to node A. However, when the display is initially turned on no data are available on node D to produce a line of the display and thus during the first line time the voltage transferred from node D to node A is whatever it happens to be at the time and is of no consequence. Also, during the first line time the happenings with transfer gates 38, 39, 40 and 41 are immaterial because of the unavailability of data at that time. During a 5 microsecond period 56, the switching transfer gate 37 is turned off and the input transfer gate 36 is turned on. During this period node D is precharged to the maximum data voltage, for example, +12 volts. At some time during the remaining 50 microseconds, period 57 in FIG. 4, of the line time the input transfer gate 36 is turned on for a 2 microsecond period 54 and node D is pulled down from the +12 volts to the data voltage available on line 31. This condition of node D continues until the start of the second line time at $T_1$, when the switching transfer gate 37 is turned on to transfer data from node D to node A.

The second line time begins at $T_1$ and is shown divided into two sets of time periods 52 and 53, which obviously occur simultaneously. The periods of line time 52 are the same as those of the first line time 51, as indicated by like reference numbers, and are relevant to the input transfer gate 36 and the switching transfer gate 37. The time periods of line time 53 are relevant to devices 37 to 41. The initial time period 55 is 10 microseconds long and, as stated above, this period is the data transfer period during which data are transferred from node D to node A. Node B is coupled to node A through coupling capacitor 44 and the autozero transfer gate 41 is turned on during this period. Node A charges to the data voltage while nodes B and C resettle to the threshold voltage of transfer gate 39. This is a very important feature because with amorphous silicon the threshold voltage varies greatly due to different voltage stresses. Each sensor device 39 is therefore caused to be self settling and alleviates the effects of threshold variations. During the next time period 58, which is 10 microseconds, the autozero transfer gate 41 is turned off. Node B then drops a few volts because of the parasitic capacitance of the transfer gate 41. The sensor transfer gate 39 is turned off during this time. The switchable load 40 is turned on to precharge node C to the +V voltage available on terminal 48. This turns on the transmission gate 26 to reset the data line 17 to the master ramp starting voltage by discharging the data line 17 through the data generator 34 (FIG. 1). During the next 32 microsecond period 59, reference ramp transfer gate 38 is turned on to apply the reference ramp voltage to node A. Initially, node A is pulled lower by the reference ramp and therefore node B also is pulled lower. As the reference ramp voltage increases the voltages on nodes A and B also increase and when node B reaches the threshold voltage of the sensor transfer gate 39 the gate starts to turn on. The voltage on node B continues to increase and gradually pulls down the voltage on node C and turns off the transmission gate 26 when the reference voltage reaches the threshold voltage of the transmission gate 26. The pixel element associated with the turned off transmission gate is therefore charged to the level established by the brightness signal applied to the comparator 24. An additional 10 microsecond period 60 of the second line time is used to provide time for the select line scanner to deselect the horizontal line 18 and to prepare the display for the next line.

The last time period 61 of line time 53 is three microseconds long, during this period the reference ramp generator transfer gate 38 is turned on to precondition node A to −3 volts. This operation resets the voltage on node A and removes the input information from the preceding line time. At the beginning of the three microsecond period 54, the switchable load 40 is also turned on for a brief period of time, which preferably is less than the three microsecond period, to raise node C to a voltage level higher than the threshold voltage of transfer gate 39. During the three microsecond period 54, the autozero transfer gate 41 is also turned on and remains on until turned off at a later time. When the autozero transfer gate 41 is turned on node B is directly connected to node C and the sensor transfer gate 39 settles to its threshold voltage after the switchable load is turned off.

The precharging of nodes C and D is an important feature because it results in a pull down type of operation and enables the rapid operation required for the comparator circuit while utilizing either low mobility amorphous silicon technology or polysilicon technology.

Figure 3:
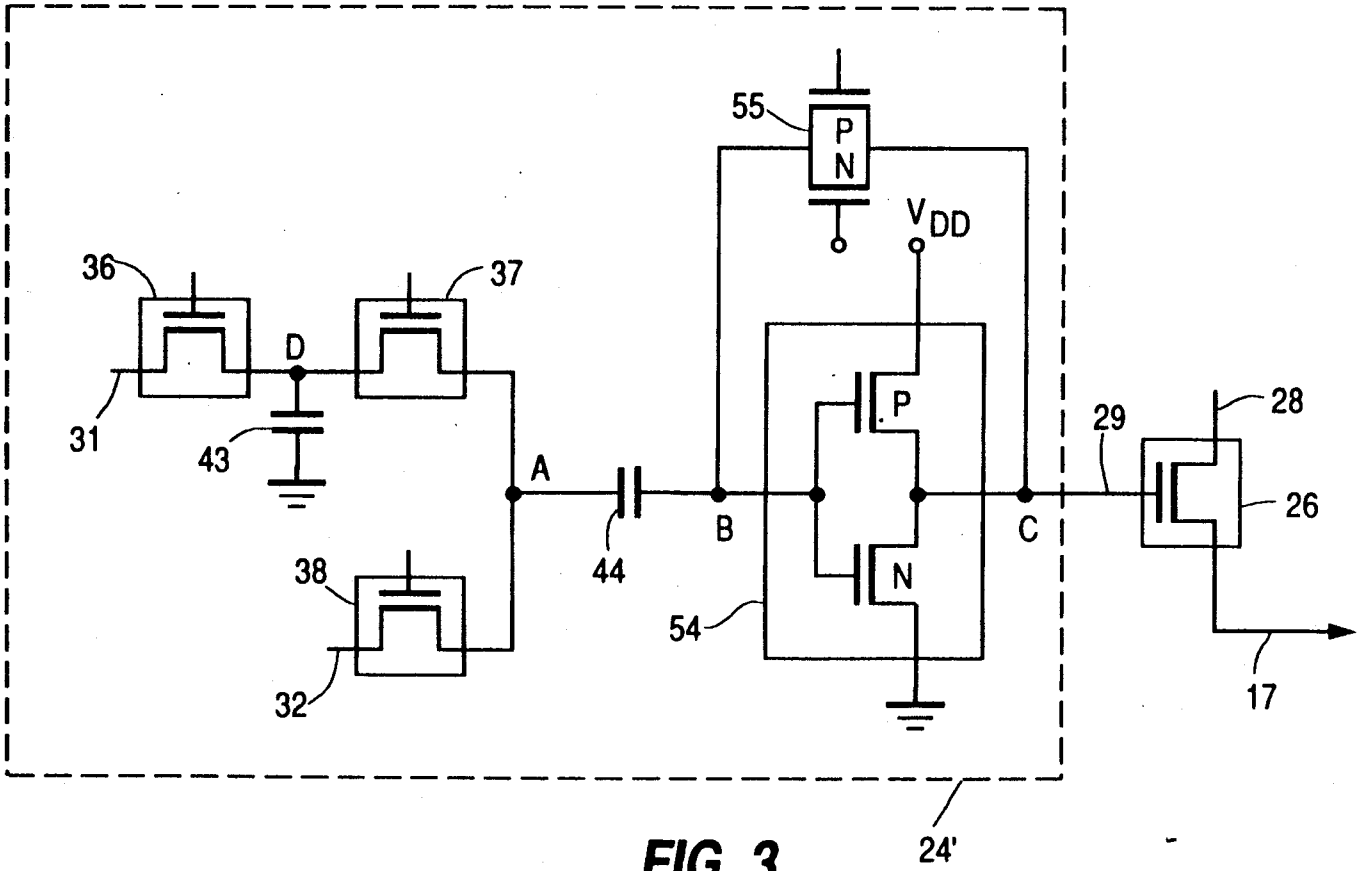
FIG. 3 is a preferred embodiment of a comparator circuit using CMOS technology.

A comparator embodiment which can be fabricated using CMOS technology is shown in FIG. 3. In the CMOS comparator 24' the sensor transfer gate 39 and switchable load 40 of the FIG. 2 embodiment are replaced by a CMOS inverter 54. Also, a CMOS transmission gate 55 can be used in place of the autozero transfer gate 41. The other transfer gates 36, 37, 38 and 26 of the FIG. 2 embodiment can also be replaced with CMOS transmission gates and the basic operation is very similar to that of the amphorous silicon embodiment of FIG. 2. The inverter 54 functions as the sensor of the voltage on node B.

During autozero the output node C and the input node B are shorted in order to set the triggering point of the inverter to its own transition point, typically about one-half volt VDD. This reduces the sensitivity of the sensor 54 to variations in the parameters of the device, such as threshold voltage and mobility and therefore increases the accuracy of the device.

The invention is a marked advance over the prior art because it enables the use of all silicon technologies to integrate the control circuitry on the same substrate as the liquid crystals in a display device having an operational speed useful in displaying color television. The invention is also advantageous because of the provision of a converter circuit which converts an amplitude dependent analog signal into a time based digital signal using only seven active components and two capacitors.

What is claimed is:

1. A system for applying data signals to the individual columns of pixel elements in a display device having a matrix of pixel elements arranged in columns and in rows comprising:

a plurality of transmission gates arranged to individually actuate said columns of pixel elements for individually applying said data signals to said columns of pixel elements, each of said transmission gates having a control electrode for turning said transmission gates on and off in response to a control signal exceeding a threshold level;

means for precharging said control electrode to said threshold level;

means for applying a data ramp to said columns of pixel elements through said transmission gates, said means for applying said data ramp including a plurality of voltage comparator means individually associated with said transmission gates for turning said transmission gates on and off whereby said data ramp is applied to the said pixel elements when said transmission gates are on:

reference ramp generator means for applying a reference ramp voltage to said voltage comparator means; and means for applying a brightness voltage to said voltage comparator, said voltage comparator turning said transmission gates on when said brightness voltage exceeds said reference ramp voltage and off when said reference ramp voltage reaches said brightness voltage.

2. The system of claim 1 wherein said voltage comparator means includes an input transfer gate for receiving said brightness voltage, and a reference ramp transfer gate for receiving said reference ramp, said input transfer gate and said reference ramp transfer gate being connected to a first node;

a second node coupled to said first node by a coupling device; and a sensor transfer gate responsive to said second node for sensing the voltage on said second node and for turning said transmission gate on and off in response to changes in the voltage on said second node.

3. The system of claim 2 wherein said voltage comparator means further includes an autozero transfer gate arranged across said sensor transfer gate for setting said sensor transfer gate to its threshold voltage.

4. The system of claim 3 further including a switchable load transfer gate for precharging said control electrode of said transmission gate to the threshold voltage of said transmission gate and for discharging said pixel elements.

5. The system of claim 2 further including a switchable load transfer gate for precharging said control electrode of said transmission gate to the threshold voltage of said transmission gate and for discharging said pixel elements.

6. A comparator for a liquid crystal display device having a matrix of liquid crystal elements and including a data ramp for charging said liquid crystal elements through a data ramp transfer gate, said comparator comprising:

a first transfer gate for receiving analog brightness signals and applying a brightness voltage to a first node;

a second transfer gate for applying an analog reference ramp to said first node;

means for sensing the voltage on said first node and for turning said data ramp transfer gate on and off in response to voltage variations on said first node;

means for presetting said means for sensing to a voltage substantially equal to the threshold level; and charge transfer means for precharging said data ramp transfer gate to its threshold level.

7. The comparator of claim 6 wherein said means for sensing includes a sensing transfer gate and a coupling device for coupling said sensing transfer gate to said first node.

8. The comparator of claim 7 further including voltage responsive switch means arranged between said first transfer gate and said first node.

9. The comparator of claim 8 wherein said first and second transfer gates, said means for sensing, said means for presetting, said sensing transfer gate, said switch means, and said charge transfer means are thin film transistors.

10. The comparator of claim 8 wherein said first and second transfer gates, said means for sensing, said means for presetting, said sensing transfer gate, said switch means, and said charge transfer means are fabricated using amorphous silicon technology.

11. The comparator of claim 8 wherein said first and second transfer gates, said means for sensing, said means for presetting, said sensing transfer gate, said switch means, and said charge transfer means are fabricated using polysilicon technology.

12. The comparator of claim 8 wherein said first and second transfer gates, said means for sensing, said means for presetting, said sensing transfer gate, said switch means, and said charge transfer means are fabricated using CMOS technology.

* * * * *